US008418813B2

(12) United States Patent
Yim et al.

(10) Patent No.: US 8,418,813 B2
(45) Date of Patent: Apr. 16, 2013

(54) WIRELESS COMMUNICATION NETWORK FOR TRANSPORTATION SAFETY SYSTEMS

(75) Inventors: Raymond Yim, Cambridge, MA (US); Philip V. Orlik, Cambridge, MA (US); Chunjie Duan, Brookline, MA (US); Jinyun Zhang, Cambridge, MA (US); Jianlin Guo, Malden, MA (US); Frederick J Igo, Jr., Ayer, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 333 days.

(21) Appl. No.: 12/950,683

(22) Filed: Nov. 19, 2010

(65) Prior Publication Data

US 2012/0129458 A1 May 24, 2012

(51) Int. Cl.
*B66B 1/28* (2006.01)

(52) U.S. Cl.
USPC ..... 187/247; 187/391; 187/249; 455/11.1

(58) Field of Classification Search ..... 187/247, 187/248, 249, 287, 289, 391, 393, 413, 414, 187/900; 340/505, 507, 518, 521, 522; 455/7, 455/11.1, 14–22
See application file for complete search history.

(56) References Cited

U.S. PATENT DOCUMENTS

| | | | | |
|---|---|---|---|---|
| 5,218,356 | A * | 6/1993 | Knapp | 342/350 |
| 5,360,952 | A * | 11/1994 | Brajczewski et al. | 187/248 |
| 6,173,814 | B1 * | 1/2001 | Herkel et al. | 187/288 |
| 6,467,585 | B1 | 10/2002 | Gozzo et al. | |
| 6,601,679 | B2 * | 8/2003 | Crenella et al. | 187/395 |
| 6,976,561 | B2 * | 12/2005 | Motoyama et al. | 187/391 |
| 7,134,530 | B2 * | 11/2006 | Motoyama et al. | 187/391 |
| 7,264,090 | B2 * | 9/2007 | Vecchiotti et al. | 187/391 |
| 7,377,364 | B2 * | 5/2008 | Tyni et al. | 187/380 |
| 7,426,981 | B2 * | 9/2008 | Bacellar et al. | 187/247 |
| 7,552,801 | B2 * | 6/2009 | Trifu | 187/391 |
| 8,014,718 | B2 * | 9/2011 | Bassiri et al. | 455/11.1 |

FOREIGN PATENT DOCUMENTS

WO 03-020625 3/2003

* cited by examiner

*Primary Examiner* — Anthony Salata
(74) *Attorney, Agent, or Firm* — Dirk Brinkman; Gene Vinokur

(57) ABSTRACT

In a network for a safety system in a transportation system, the transportation system includes a shaft and a car arranged in the shaft. A first wall node is at a first end of the shaft and a second wall node is at a second end of the shaft to communicate safety messages with the car. Each wall node includes at least one wireless transceiver connected to one or more antennas. Each car in the shaft includes at least two wireless transceiver connected to one or more antennas, wherein the first transceiver of the car uses a first frequency and the second transceiver of the car uses a second frequency to communicate each safety messages in duplicate. A wired backbone connects the set of wall nodes to a controller of the safety system of the transportation system.

15 Claims, 10 Drawing Sheets

WIRELESS COMMUNICATION NETWORK FOR TRANSPORTATION SAFETY SYSTEMS

FIELD OF THE INVENTION

This invention relates generally to mobile wireless networks, and more particularly to reliable communications used in safe transportation systems, such as elevator systems.

BACKGROUND OF THE INVENTION

Communications in a safety system require very high reliability and very low latency. Therefore, the communications are conventionally performed using dedicated wired medium. For example, in an elevator system, in order to send safety messages between a controller and an elevator car, a heavy communication cable is suspended in the shaft, and moves along with the car. As building height increases, the weight and cost of the communication cable increases significantly. As the weight increases, power consumption for the elevator system also increases. Building height has a multiplicative effect on total cost and power consumption of elevator systems. A lower cost and more energy efficient solution is desired for safety systems in elevator systems. A possible solution is to replace wired communications by wireless communications.

To ensure the safety of elevator passengers, the International Electronic Commission (IEC) has published stringent safety and reliability requirements for elevator communication networks that only allow one error in a quadrillion ($10^{15}$) safety related messages. However, wireless communication is subject to external interference and variable wireless channel conditions. In addition, wireless communication has a limited transmission range, especially in indoor settings. Therefore, it is very challenging to apply wireless communications to safety systems for elevator systems.

Therefore, it is desired to provide a reliable wireless communication network that satisfies stringent safety and reliability requirements for elevators, and other similar safety systems.

SUMMARY OF THE INVENTION

Embodiments of the invention provide a method and system for reliable wireless communications between a controller and cars in an elevator system. Specifically, in a network for a safety system in a transportation system, the transportation system includes a shaft and a car arranged in the shaft.

A first wall node is at a first end of the shaft and a second wall node is at a second end of the shaft to communicate safety messages with the car. Each wall node includes at least one wireless transceiver connected to one or more antennas.

Each car in the shaft includes at least two wireless transceiver connected to one or more antennas, wherein the first transceiver of the car uses a first frequency and the second transceiver of the car uses a second frequency to communicate each safety messages in duplicate.

A wired backbone connects the set of wall nodes to a controller of the safety system of the transportation system.

DETAILED DESCRIPTION OF THE PREFERRED EMBODIMENT

The embodiments of our invention provide a safety system, which uses wireless communications, for a transportation system, e.g., an elevators system. It should be understood that the safety system can be used in other transportation system with demanding communication and safety requirements, e.g., mine shafts and galleries, and underground or underwater transportation tunnels.

Therefore, as defined here, a shaft is any relatively narrow, elongated and an enclosed space. Typically, the shaft is longer than 20 meters. The shaft includes one or more cars for transporting people or goods. The cars can move in the shaft, either horizontally, vertically, or the shaft can be inclined. Because of the length of the shaft, and because each car can substantially fill a cross section of the shaft, conventional wireless communications are generally inadequate.

A primary concern of the invention is to communicate safety messages between the car and a controller, which controls the operation of the car in the shaft. Therefore, any of the nodes can be a source or sink for the safety messages.

The system can be implemented for buildings with one or more elevator shafts, and one or more elevator cars per shaft. The communications are between a car node arranged on the car, a set of (one or more) intermediate wall nodes arranged in the shaft, and a controller. The wall nodes and controller are interconnected by a wired backbone. The car and car nodes are moveable, while the wall nodes and controller are fixed in place. Each node includes at least one wireless transceiver, which is a transmitter and receiver, connected to one or more antennas.

For reliable communication, each car has at least two car nodes (transceivers). More car nodes can be used to improve reliability.

The wall nodes serve as relay nodes between the car nodes and the controller. The wired backbone can carry messages between wall nodes and the controller, in one shaft or multiple adjacent shafts.

Short Buildings

Figure 1A:
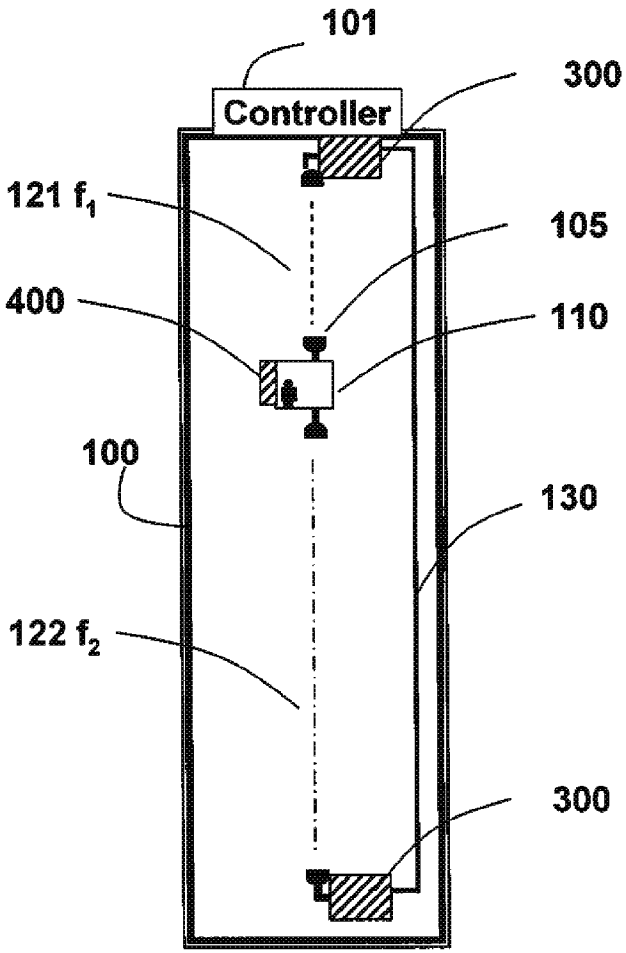
FIG. 1A is a schematic of an elevator safety system for a short building with a single shaft and single car in an elevator system.

As shown in FIG. 1A, when the elevator system 101 is in a short building 100, if the elevator system services only a small number of floors, such that the height of the service zone is less than or equal to the range of a radio transmission, two (hatched) wall nodes 300 can be used, a first wall node at a first (bottom) end of the shaft end, and a second wall node at a second (top) end of the shaft.

The two antennas 105 of a car node 400 at the car 110 are arranged so that one transceiver communicates with the top wall node using frequency $f_1$ 121 and the second transceiver communicates with the bottom wall node using frequency $f_2$ 122. While it is preferred that $f_1$ is distinct from $f_2$, it is not a strict requirement, because the frequencies used depend on the actual radio technology, as long as the frequencies do not create significant interference in the vicinity of the receiver. A wired backbone 130 communicates between the wall nodes.

The frequencies $f_1$ and $f_2$ can be in a millimeter wave band, a sub-6 GHz band, or one frequency can be selected from the millimeter wave band, and the other from the sub-6 GHz band.

In the preferred architecture, both frequencies are selected in the industrial, scientific and medical (ISM) radio bands, e.g., 24 GHz or 60 GHz. Millimeter wave transmission is generally immune to interference originating outside of the shaft, and also provides a narrow beam that can travel a longer distance. Using millimeter wave radio frequency, with transmission power of 10 dBm and directional antennas of up to 30 dBi gain, only two wall nodes are required for shafts up to lengths of 200 meters. Conventional wireless safety systems are generally limited to shaft less than 10 meters. Hence, the length of the shaft is a main stumbling block for using conventional wireless networks.

Alternatively, the frequencies can be selected in the sub-6 GHz band, e.g., 2.4 GHz or 5.8 GHz. However, then external interference (from existing systems, e.g. WiFi networks) is an issue, and a high gain antenna is generally larger and heavier. With sufficient transmission power and antenna gain, two wall nodes can be used in elevator shafts up to heights of 100-200 meters when the shaft is interference free. Under the worst-case interference scenario, the wall nodes can be used in elevator shafts up to heights of 10-20 meters.

Alternatively, the frequency $f_1$ can be selected from the millimeter wave band, and frequency $f_2$ can be selected from a sub-6 GHz band.

In the preferred embodiment, the wired backbone 130 between the floors can be a riser-graded fiber optic cable. The cable has at least two fibers, a first fiber for a downlink from the controller to the wall nodes, and the second fiber for an uplink from the wall nodes to the controller.

Figure 1B:
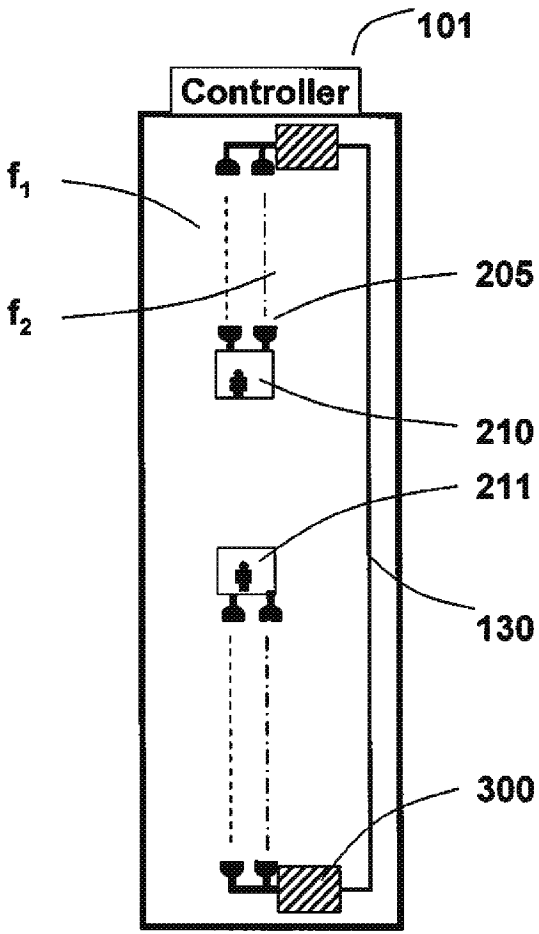
FIG. 1B is a schematic of an elevator safety system for short building with a single shaft and two cars in an elevator system.

As shown in FIG. 1B, some elevator systems support two independently moving cars 210-211 in a single shaft. In this case, for short buildings, each node is equipped with two wireless radio transceivers 205. The wall node at the top of the shaft uses both antennas to communicate with the car services higher floors. Likewise, the wall node at the bottom of the shaft uses both antennas to communicate with the car that services lower floors.

Tall Buildings

Figure 2A:
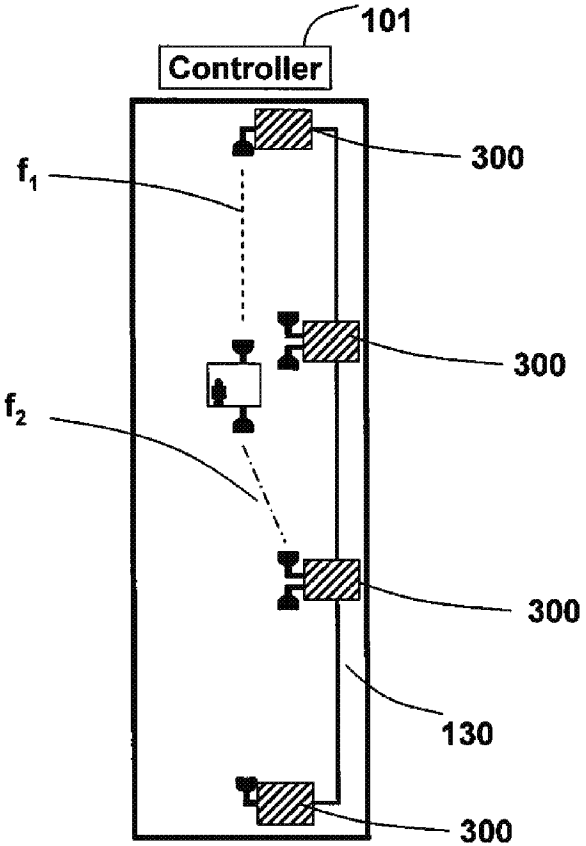
FIG. 2A is a schematic of an elevator safety system for a tall building with a single shaft and single car in an elevator system.

As shown in FIG. 2A, more than two wall nodes 300 are required for tall buildings. The wall nodes are arranged linearly along the shaft or attached to the shaft railing. The wall nodes located at the top and bottom of a shaft have only one radio transceiver, and all other wall nodes have two transceivers. The backbone 130 interconnects wall nodes to each other.

When millimeter wave band is used for the wireless communication, the antennas can be highly directional. The two antennas in each wall node point in opposite directions, one upward and the other downward. All downward pointing antennas of wall nodes use frequency $f_1$, and all upward pointing antennas of wall nodes use frequency $f_2$. At the car, an upward pointing antenna communicates using frequency $f_1$, and a downward pointing antenna use frequency $f_2$. Using the millimeter wave band with high gain antennas, the distance between wall nodes can be between 100-200 meters.

Figure 2B:
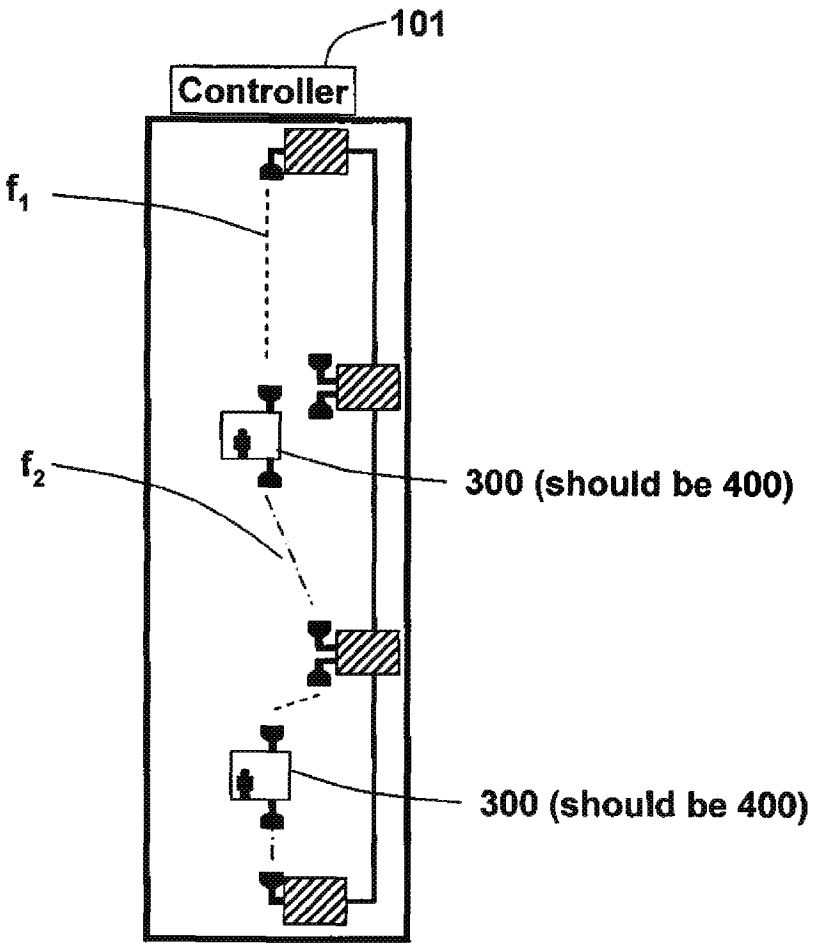
FIG. 2B is a schematic of an elevator safety system for a tall building with a single shaft and two cars in an elevator system.

FIG. 2B shows a similar architecture for tall buildings with two cars in a shaft.

Node Configurations

Figure 3:
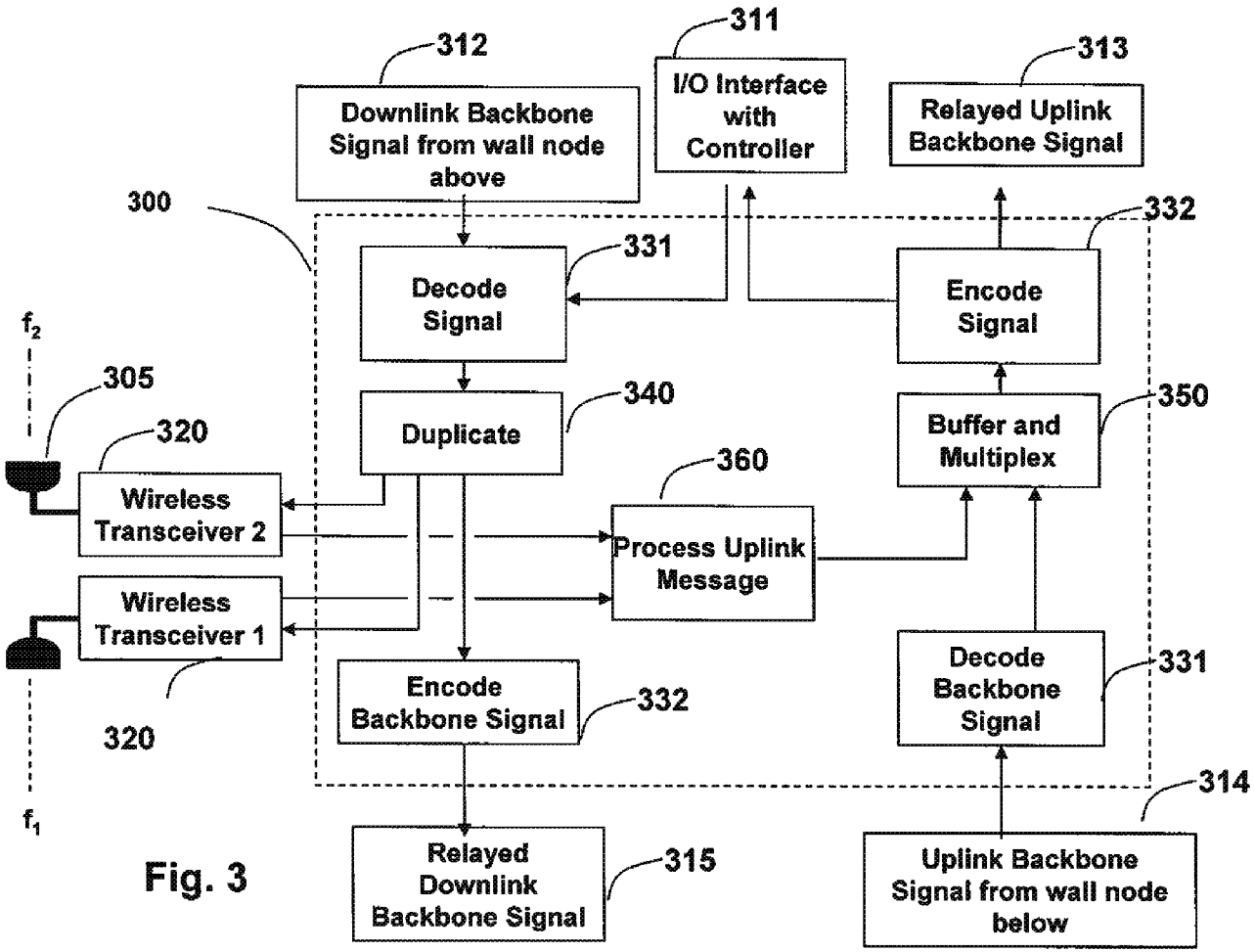
FIG. 3 is a block diagram of a wall node of an elevator safety system.

FIG. 3 shows components and an operation of a wall node 300. The wall node has the following input/output (I/O) ports: I/O interface with controller 311, input port to receive downlink (DL) backbone signal 312, output port to relay downlink backbone signal 315, input port to receive uplink (UL) backbone signal 314, output port to relay uplink backbone signal 313, two I/O ports to wireless transceivers 320.

The wall node includes decoders 331, encoders 332, a duplicator 340, a buffer and multiplexer 350, and a module 360 to process uplink messages.

A wall node can be configured as one of the three node types: Head, Relay and Terminal. The ports can be enabled or disabled depending on the node type assignment of wall nodes as shown in Table I.

TABLE I

| Node Type | I/O with Controller | Input DL | Output DL | Input UL | Output UL |
|---|---|---|---|---|---|
| Head | Enabled | Disabled | Enabled | Enabled | Disabled |
| Relay | Disabled | Enabled | Enabled | Enabled | Enabled |
| Terminal | Disabled | Enabled | Disabled | Disabled | Enabled |

When a port is disabled, an implementation can select to not install related components in an actual device.

When the wall node is adjacent to the controller, the node type is Head. In this case, the node directly receives DL messages from the controller, therefore the node disables the input of the DL backbone signal, 312. The Head node can select to buffer and combine multiple DL messages to improve communication efficiency. The wall node can also send UL messages directly to the controller, and thus disables its output to relay UL message through backbone.

When a wall node is located at a furthest distance from the controller, e.g., at the bottom of the elevator shaft when the controller is at the top of the shaft, the node type is Terminal. In this case, the node disables output of relaying DL backbone 332, and disables input of UL backbone signal 314. The node also disables the I/O to controller 311.

All other wall nodes are type Relay. In this case, the node disables I/O to the controller 311. All DL messages are taken from the input from DL backbone.

For Head and Relay nodes, all DL messages are duplicated 340, and relayed to the output of DL backbone, and sent to the wireless transceivers 320. For Terminal node, the DL messages are only sent to the wireless transceivers 320.

The output UL message is constructed based on the signal received from the input UL backbone 314, and the wireless transceivers 320. The received signal of the two wireless transceivers are processed 360, and then buffered and multiplexed 350, with the decoded backbone signals received from the UL backbone 331.

Even though the wall node is equipped with two I/O ports for wireless transceivers, it is possible to configure the wall node so that only one of transceiver is active. For example, a Head type wall node can use only one wireless transceiver for cases shown in FIGS. 1A, 2A and 2B, or the Head wall node can use two transceivers for the case shown in FIG. 1B.

Figure 4:
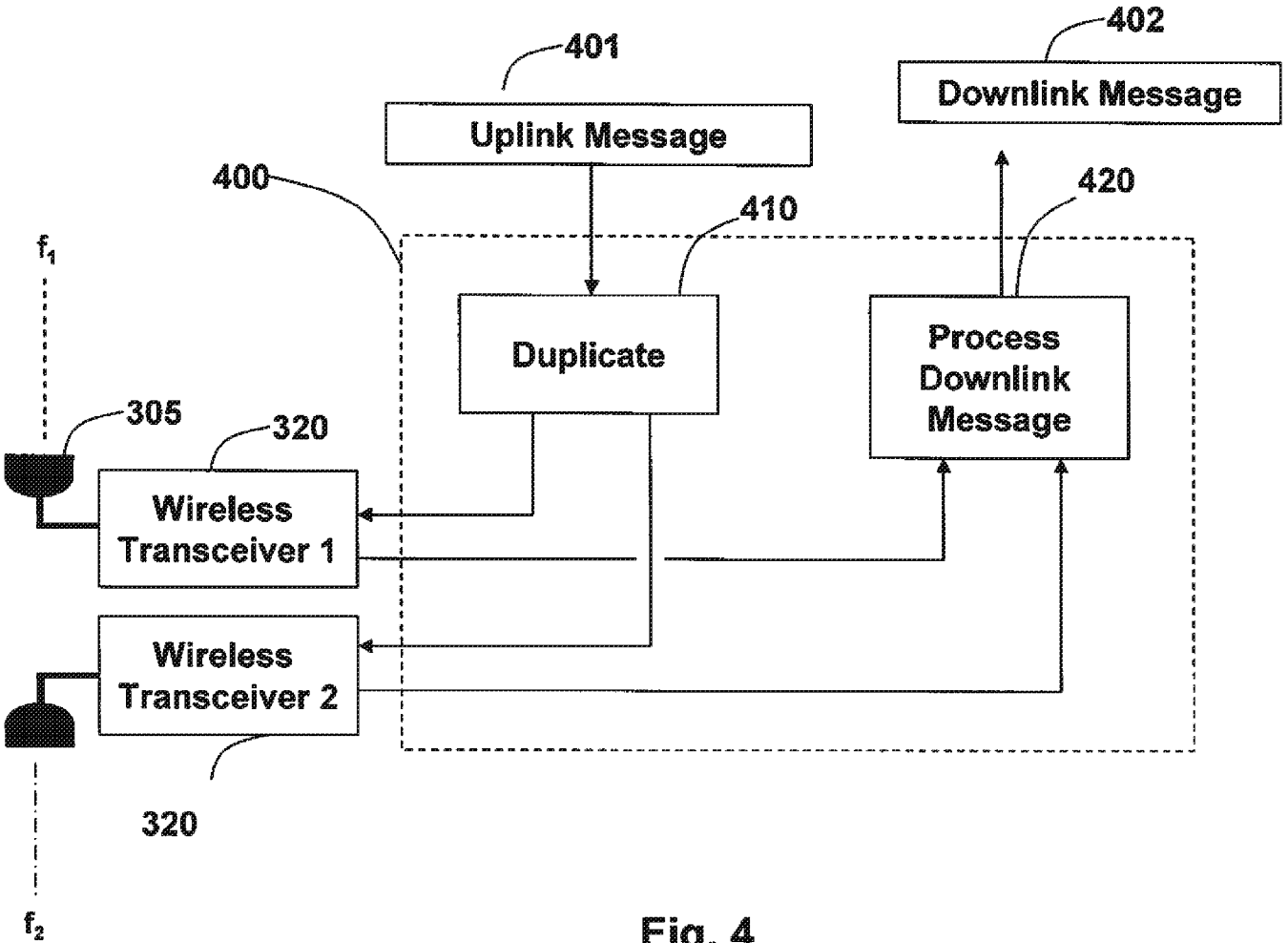
FIG. 4 is a block diagram of a car node of an elevator safety system.

As shown in FIG. 4, a car node 400 duplicates 410 uplink messages 401 and sends the message to the two antennas 305 of the transceivers. The wireless transceivers 320 also receive downlink messages 402, process 420 the messages.

Redundant Transmission

Figure 5:
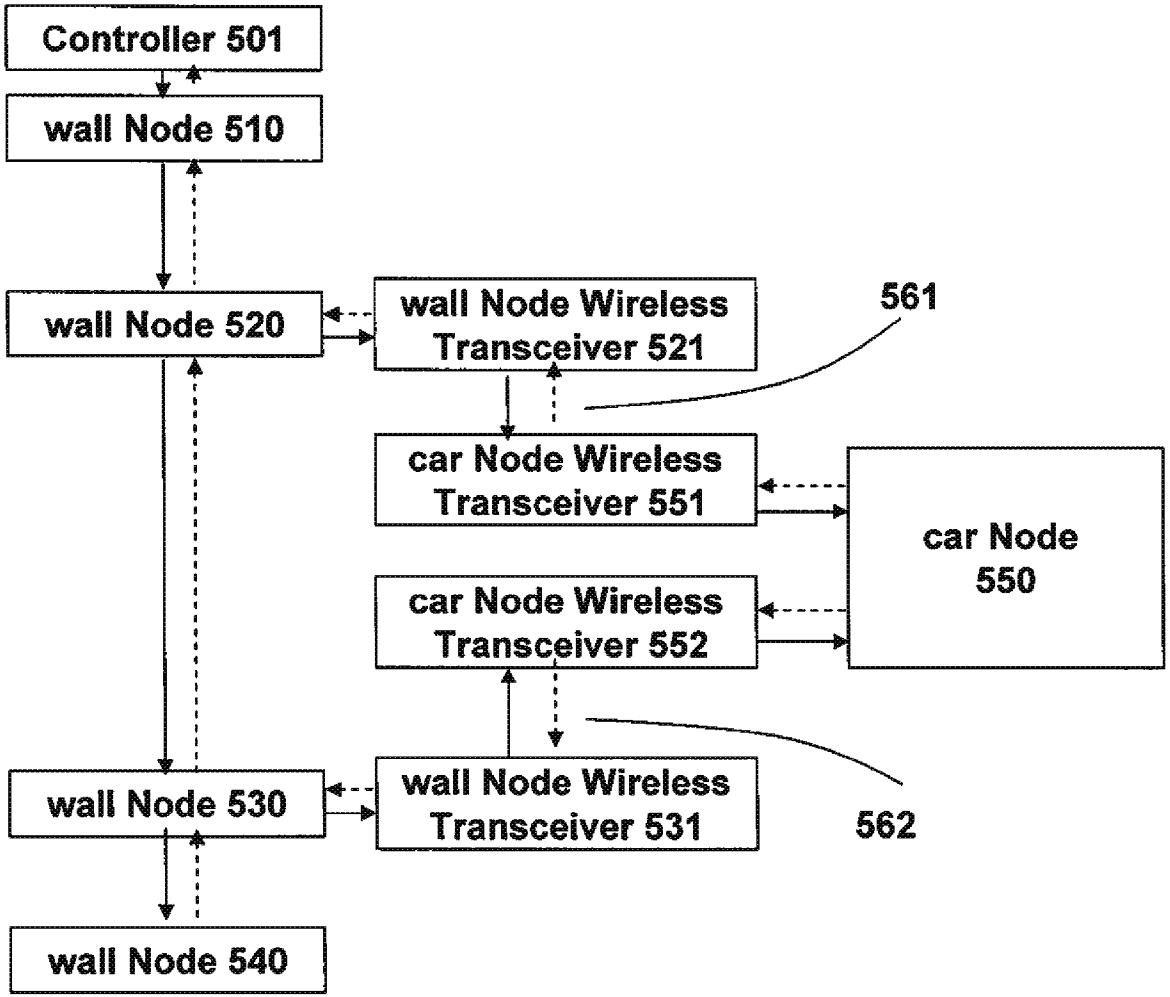
FIG. 5 is a flow diagram of a downlink communication protocol with redundancy for an elevator safety system.

To ensure reliability, signals are transmitted to a car over two independent wireless paths, a primary path 561 and a redundant path 562, as shown in FIG. 5. DL messages flow from controller 501 to a car node 550 through two paths (solid lines), while UL messages flow from the car node 550 to the controller 501 also through two paths (dashed lines). We assume that the car node is located somewhere between two wall nodes, wall node 520 and wall node 530. The controller passes messages to the wall node 510, and the messages are relayed to wall node 520. Wall node 520 duplicates each message and sends one copy to wall node wireless transceiver 521, and relays the other copy to wall node 530. Wall node 530 proceeds similarly. It duplicates each message, sends one copy to wall node wireless transceiver 531, and relays another copy to wall node 540.

Both wall node wireless transceivers 521 and 531 receive a copy of the DL message, at different times. The wall node independently transmits the message wirelessly to the car node. In one path, which we call the primary path, a wireless signal is sent from wall node wireless transceiver 521 to car node wireless transceiver 551. In another path, which we call the redundant path, a wireless signal is sent from wall node wireless transceiver 531 to car node wireless transceiver 552. Then, the car node receives the message from both wireless transceivers 551 and 552. The probability that the message is received successfully via at least one path is higher than a design with only a single communication path, thus improving reliability.

During a downlink transmission, after the wall nodes relay messages via the backbone, multiple wall nodes corresponding to the same path, e.g., the primary path, transmit the message simultaneously to avoid interference to each other. These transmissions using the same frequency channel are combined over the wireless channel by law of nature. However, the slight differences in distance, even when the signal travels at speed of light, the signal may be combined with small time offset. The car node can either (1) decodes the message by using the combined signal, or (2) performs advanced signal processing to select one of the many paths and decode the message.

To clarify, wall nodes corresponding to the primary path transmit at the same time, and wall nodes corresponding to the redundant path transmit at the same time. However, the transmission of primary and redundant path may be independent of each other.

Note that a message can be retransmitted multiple times over the same channel to improve the probability of successful message reception and overall system reliability.

Similarly, UL messages from the car node to the controller node are transmitted over two independent paths shown by the dashed lines in FIG. 5.

During an uplink transmission, when a car node transmits, multiple wall nodes may receive a copy of the transmitted signal independently. In this case, the wall nodes relay every received copy of the transmission to the controller.

Frequency Allocation for Multiple Shafts

Figure 6A:
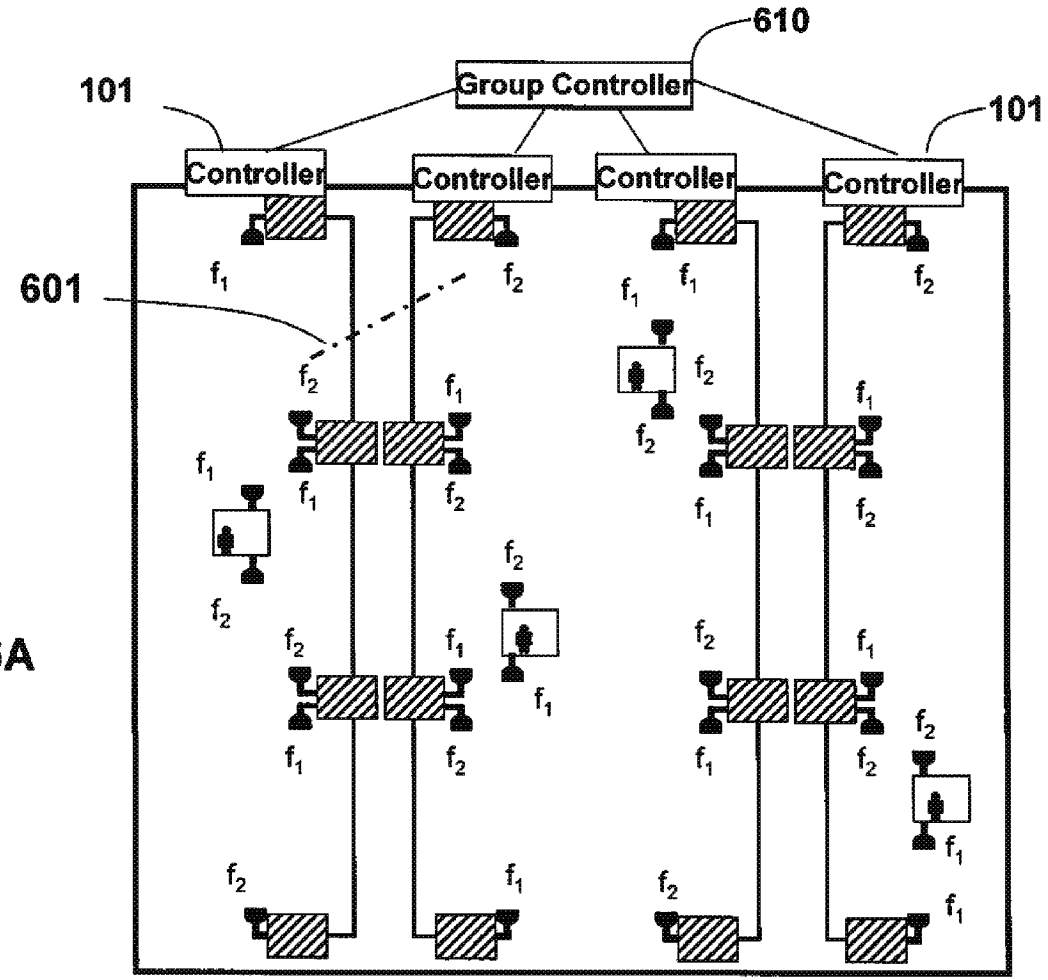
FIG. 6A is a schematic of frequency allocation and interference in a building with multiple elevator shafts using two frequency channels.

As shown in FIG. 6A, many buildings include a group elevator system where multiple cars travel adjacent to each other in adjacent shafts. Generally, the shafts are arranged in one large open space in a core of the building. That is, each shaft mainly comprises the guide rails on which the car travels, and the rest is open space. The controllers 101 for the adjacent shafts are interconnected with a group controller 610.

In a group elevator system, wireless communications between the various nodes placed in the adjacent shafts can interfere 601 with each other. Frequency allocation can be used to improve performance.

In some countries for certain radio frequency bands, only two frequency channels are permitted. In FIG. 6A, we show the frequency assignment for this case. When a shaft uses $f_1$ for downward transmission (from wall node) and $f_2$ for upward transmission, the adjacent shaft reverses the use of the two frequencies, using $f_1$ for upward transmission and $f_2$ for downward transmission. Note that in FIG. 6A, transmission of two wall nodes can interfere with one another.

Figure 6B:
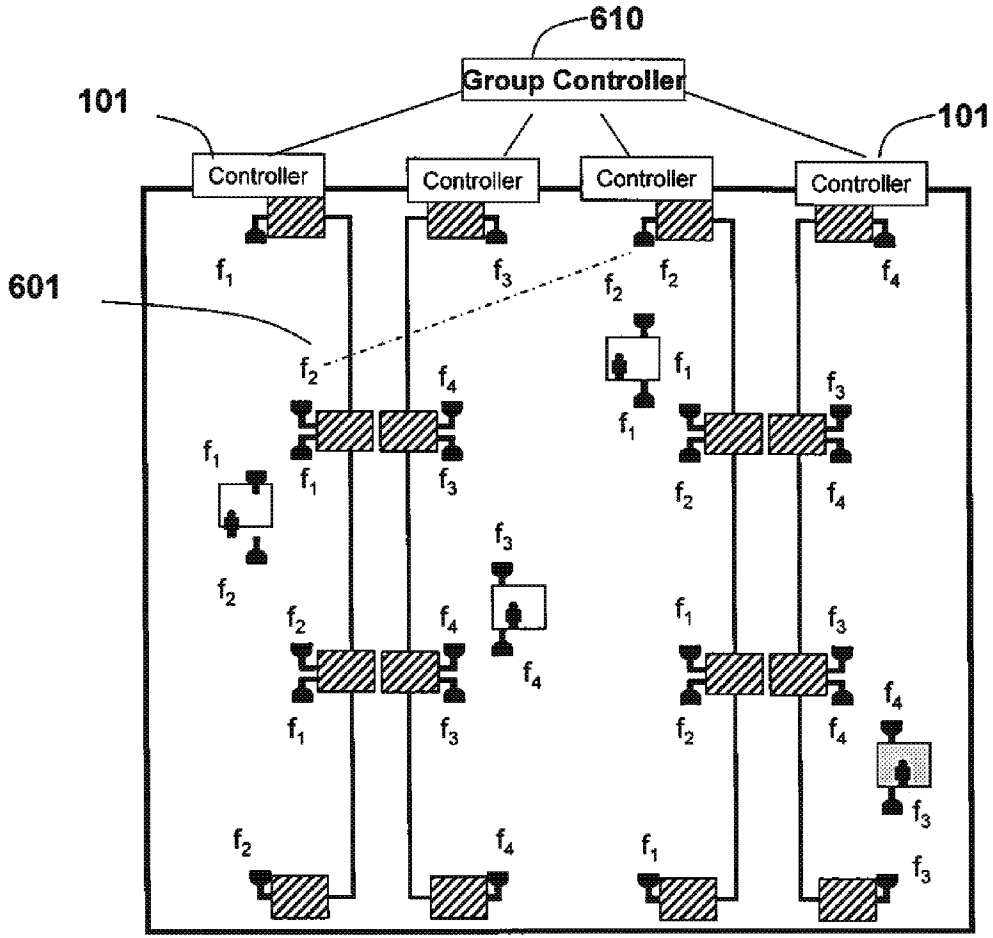
FIG. 6B is a schematic of frequency allocation and interference in a building with multiple elevator shafts using four frequency channels.

The IEEE 802.11ad standard for wireless local area networks allows additional frequencies. If four frequency channels can be selected in a frequency band, then the frequency assignment can be changed to what is shown in FIG. 6B. Adjacent shafts use completely different frequencies, and the upward and downward frequency assignments are swapped for the adjacent shafts.

Shared Backbone

Figure 7:
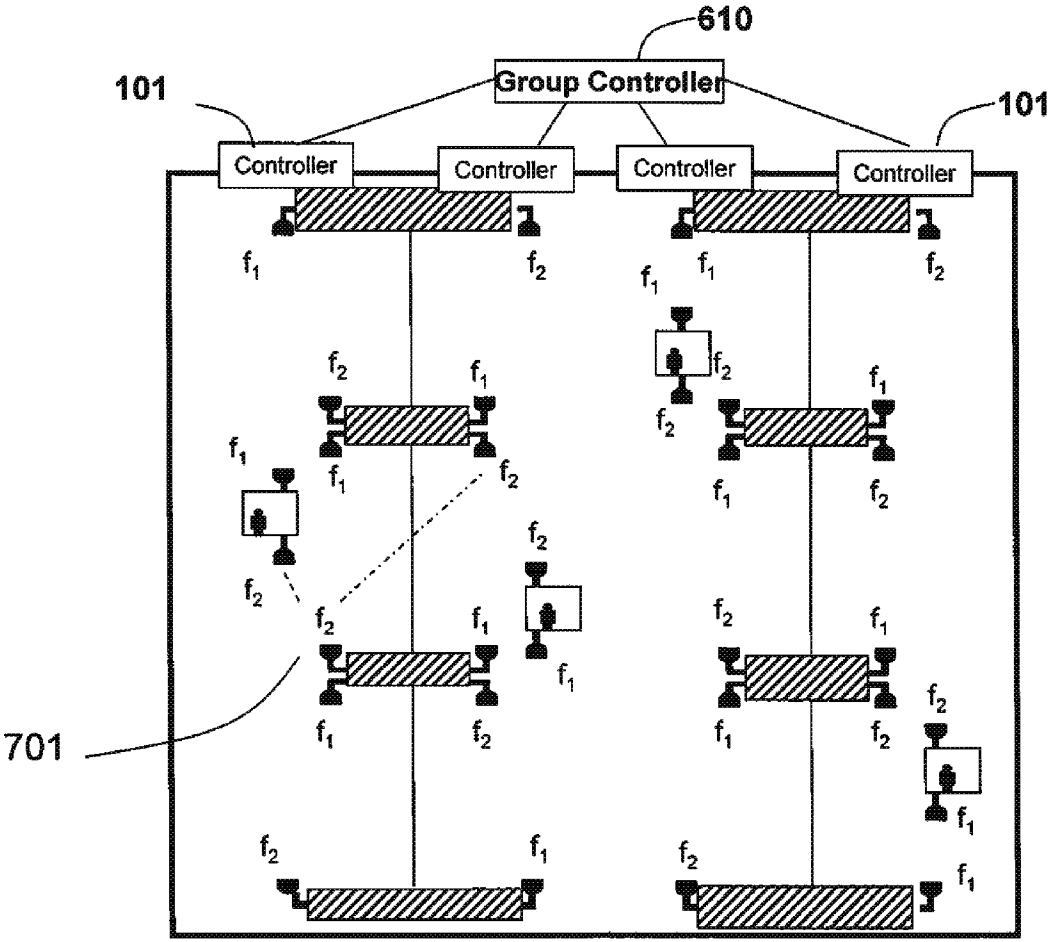
FIG. 7 is a schematic of a shared backbone between multiple elevator shafts.

If the backbone 130, see FIG. 1, has large capacity, it is possible to combine the functionality of multiple backbones into one. Although additional protocol overhead is required to identify a source and destination of a message, an integrated backbone allows adjacent wall nodes to be combined and to implement cancellation of interference, see FIG. 7.

Both downward transmissions from a car of one shaft and a wall node of another shaft use frequency $f_2$ 701, and a wall node serving the car receives transmission on frequency $f_2$. The two transmissions cause interference to one another.

However, with shared backbone, the transmission of wall nodes of an adjacent shaft is transmitted over a same backbone. Hence, the transmission is known to wall nodes in both shafts. A wall node can then use this information to cancel wireless transmission from an adjacent wall node.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

We claim:

1. A network for a safety system in a transportation system, wherein the transportation system includes a shaft and a car arranged in the shaft, wherein the shaft is relatively narrow, elongated and an enclosed space, and wherein the shaft is fixed in place and the car is moveable within the shaft, and the car substantially fills a cross section of the shaft:

a set of wall nodes arranged in the shaft, wherein each wall node is fixed in place, and wherein the set of wall nodes includes a first wall node at a first end of the shaft, and a second wall node at a second end of the shaft, and other wall nodes in between as relay nodes, wherein each wall node includes at least one wireless transceiver connected to one or more antennas and each wall node is a source or sink of safety message;

a set of car nodes arranged on the car, wherein each car node includes at least two wireless transceiver connected to one or more antennas, wherein each transceiver includes a transmitter and a receiver, wherein each car node can be the source or sink of the safety messages, wherein the first transceiver uses a first frequency and the second transceiver uses a second frequency to communicate each safety messages in duplicate; and a wired backbone connecting the set of wall nodes to a controller of the safety system of the transportation system.

2. The network of claim 1, wherein the frequencies are selected in industrial, scientific and medical (ISM) radio bands.

3. The network of claim 1, wherein the backbone is a riser-graded fiber optic cable including at least two fibers, a first fiber for a downlink from the controller to the wall nodes, and the second fiber for an uplink from the wall nodes to the controller.

4. The network of claim 1, wherein a length of the shaft is substantially greater than 10 meters.

5. The network of claim 1, wherein the shaft includes multiple cars moving independently.

6. The method of claim 1, wherein a distance between the first wall node and the second wall node is greater than 100 meters.

7. The network of claim 1, wherein the transportation system includes multiple shafts, and each shaft including one or more cars.

8. The network of claim 1, wherein each wall node duplicates downlink backbone signals so that the signals are communicated to all wireless transceivers, and the signals are relayed to another wall node via backbone.

9. The network of claim 1, wherein both downlink and uplink signals are transmitted and received over at least two independent wireless channels.

10. The network of claim 1, wherein each safety message from the controller is retransmitted simultaneously by multiple wall nodes, and wherein each car node decodes the safety messages by combining all the received safety messages.

11. The network of claim 1, wherein each safety message from the controller is retransmitted simultaneously by multiple wall nodes, and wherein each car decodes the safety messages by selecting one of the received safety messages.

12. The network of claim 1, wherein a transmission from each car node is received by multiple wall nodes, and the wall nodes send all received copies to the controller via the backbone.

13. The network of claim 7, wherein the backbone connects the wall nodes in the multiple shafts.

14. The network of claim 2, wherein the frequencies are selected in millimeter wave bands at 24, 25 or 60 GHz.

15. The network of claim 2, wherein the frequencies are selected in sub-6 GHz bands at 2.4 or 5.8 GHz.

* * * * *